US005544872A

United States Patent [19]

Schuit

[11] Patent Number: 5,544,872

[45] Date of Patent: Aug. 13, 1996

[54] UNIVERSAL, HYDRAULIC, SELF ADJUSTING, WORK CLAMPING DEVICE

[76] Inventor: Johannes Schuit, 1433 Camilo Trillado, Carpinteria, Calif. 93013

[21] Appl. No.: 288,688

[22] Filed: Aug. 11, 1994

[51] Int. Cl.[6] ..... B25B 5/14

[52] U.S. Cl. ..... 269/26; 269/60; 269/148; 269/208; 269/266

[58] Field of Search ..... 269/266, 60, 91–94, 269/204, 208, 148, 20, 25, 26

[56] References Cited

U.S. PATENT DOCUMENTS

| | | | |
|---|---|---|---|
| 1,807,297 | 5/1931 | Manley | 269/208 |
| 2,473,643 | 6/1949 | Froblom | 269/148 |
| 2,631,483 | 3/1953 | Swain | 269/204 |
| 3,689,057 | 9/1972 | Webster | 269/60 |
| 3,868,102 | 2/1975 | Pevar | 269/266 |
| 4,331,326 | 5/1982 | Strouss | 269/93 |
| 5,137,263 | 8/1992 | Savoie et al. | 269/266 |

*Primary Examiner*—Robert C. Watson
*Attorney, Agent, or Firm*—William W. Haefliger

[57] ABSTRACT

Apparatus for clamping and orienting work relative to a tool, for processing, comprising, in combination two laterally extending longitudinally separated support bars, and connector means connected to and extending between the bars for positioning them in fixed separated condition, there being work receiving space between the bars; bar leveling means extending downwardly from the bars for supporting the bars on a support bed, the means being adjustable to adjust the leveling of the bars; and work clamping pistons carried by the bars for hydraulically actuated movement toward the work receiving space for engaging and clamping the work to hold the work in fixed position relative to the bed.

9 Claims, 4 Drawing Sheets

UNIVERSAL, HYDRAULIC, SELF ADJUSTING, WORK CLAMPING DEVICE

BACKGROUND OF THE INVENTION

This invention relates to work gripping devices, and more particularly to an improved device capable of gripping work pieces of varying and unpredictable surface configuration.

There are continuing problems presented when work pieces of varying surface configurations are to be held or positioned relative to apparatus employed to process the work. For example, projecting shoulders, wall curvatures, and abutments on heavy work pieces present the problem as to how to rigidly grip such work, for firmly locating such pieces during machining operations. Large engines and transmission castings are examples of such work. Accordingly, there is great need for simple, easily adjusted, automatically operating work gripping means, capable of effectively gripping such work in a simple manner, for lifting and supporting the work, as during such processing.

SUMMARY OF THE INVENTION

It is a major object to provide improved apparatus meeting the above need. Basically, the apparatus of the invention comprises:

a) two laterally extending longitudinally separated support bars, and connector means connected to and extending between said bars for positioning them in fixed separated condition, there being work receiving space between the bars, b) bar leveling means extending downwardly from the bars for supporting the bars on a support bed, the leveling means being adjustable to adjust the leveling of the bars, c) and work clamping pistons carried by the bars for hydraulically actuated movement toward the work receiving space for engaging and clamping the work in that space to hold the work in fixed position relative to the bed.

As will appear, there are typically multiple of such pistons carried by each bar and hydraulic fluid passages in each said bar to intercommunicate the pistons carried by that bar, the pistons having reduced end portions to locally engage work surfaces. Also, adjustable displacement means is provided for displacing hydraulic fluid toward all of the pistons carried by each bar. The bar typically has spaced apart sides, the pistons protruding from one of those sides, and the displacement means protruding from another of those sides.

Another object is to provide connection means in the form of two longitudinally extending laterally spaced rods extending between said bars. Openings in the bars receive the rods, there being at least three of such openings in each bar, whereby two of the openings receive the rods and the third openings are adapted to alternately receive one of the rods, to enable adjustment of the size of the work space. Typically three pistons are carried by each bar, there being three cylindrical openings in each bar to receive the three pistons; and the pistons are independently movable in those openings, in directions extending toward the work space.

Yet another object is to provide leveling means that includes two threaded members projecting downwardly from threaded openings in one bar, and at least one threaded member projecting downwardly from at least one threaded opening in the other bar. Hold down members may be carried by the leveling means, to connect to a machine bed.

The method of using the apparatus typically includes: first positioning the bars and rods to extend about the work; then causing the pistons to variably clamp the work; then inverting the bars and rods and work; and then supporting the inverted bars on a support, with the work suspended by the bars via the pistons.

These and other objects and advantages of the invention, as well as the details of an illustrative embodiment, will be more fully understood from the following specifications and drawings, in which:

DRAWING DESCRIPTION

GENERAL DESCRIPTION

Figure 1:
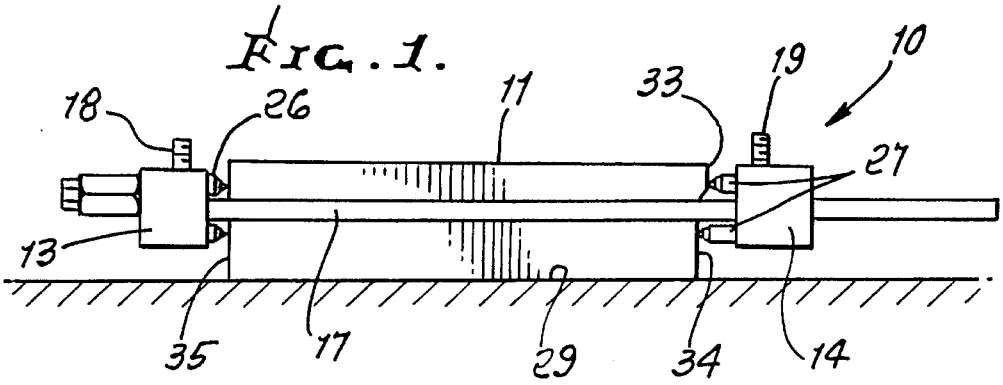
FIG. 1 is an elevation showing work clamping and support apparatus of the invention, in inverted work receiving position.
Figure 2:
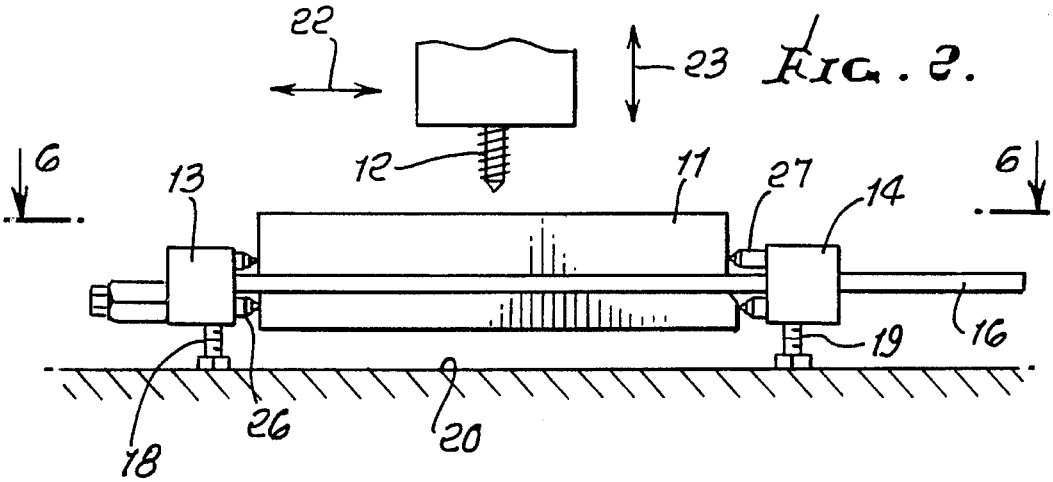
FIG. 2 is like FIG. 1, but shows the apparatus in upright non-inverted position.
Figure 6:
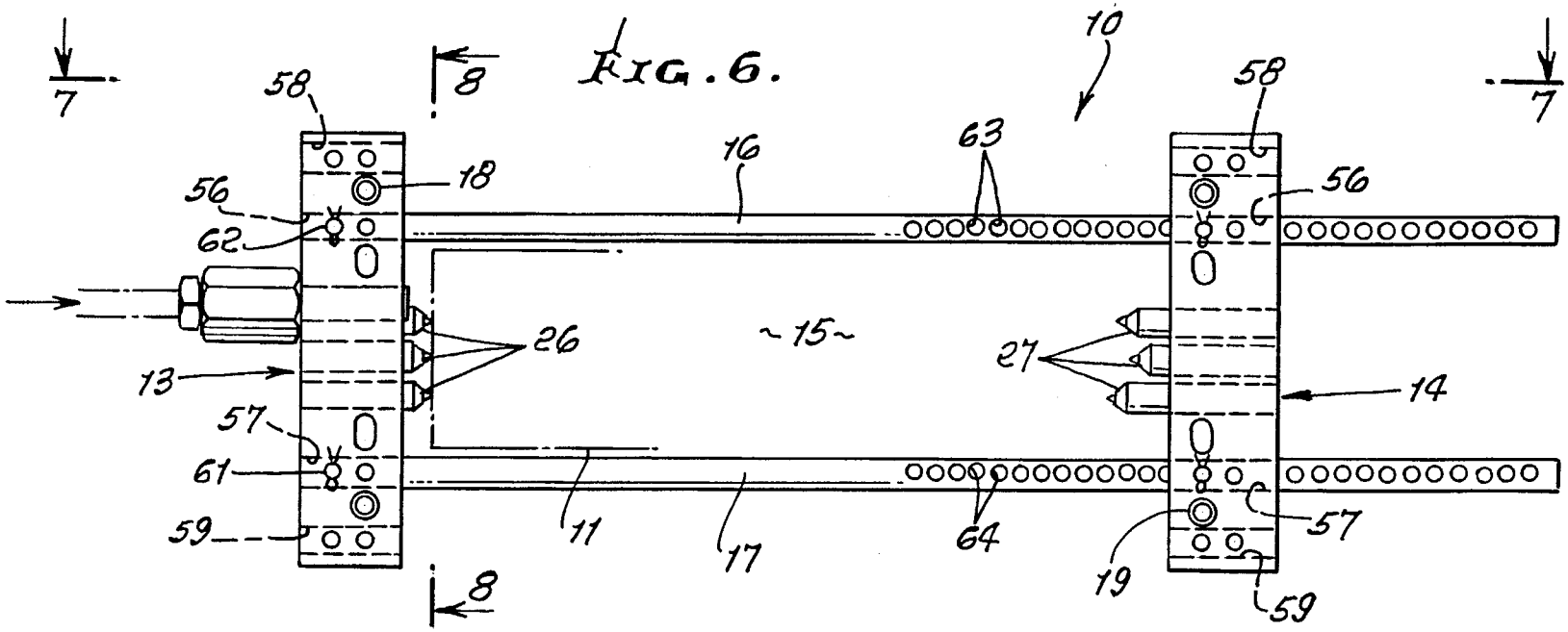
FIG. 6 is an overall plan view taken on lines 6—6 of FIG. 2.
Figure 7:
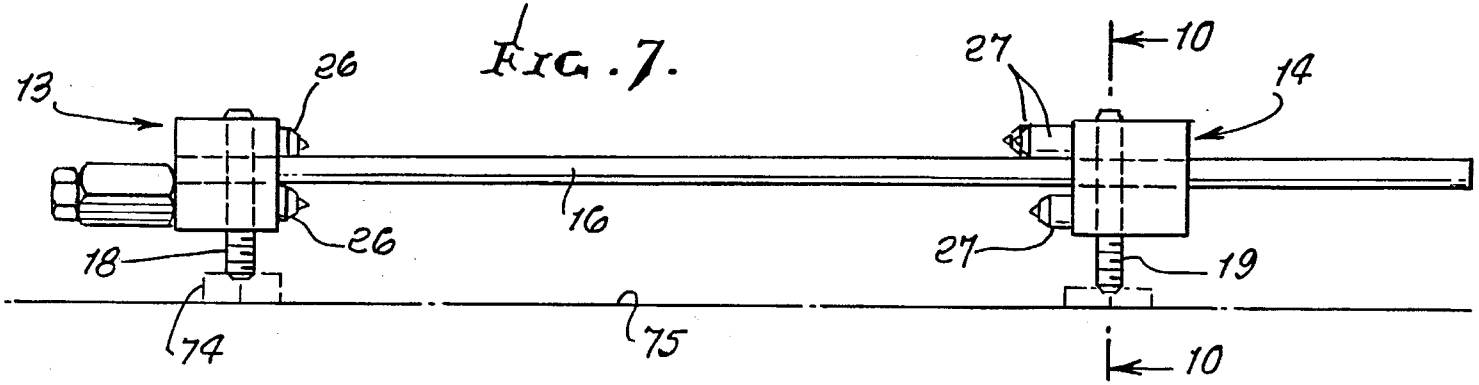
FIG. 7 is a side elevation taken on lines 7—7 of FIG. 6.

Referring first to FIGS. 1, 2 and 6, the apparatus 10 is adapted for clamping and orienting work 11 relative to a tool 12, for work processing. The tool may for example be a machine tool, such as a drill, lathe or milling cutter, polisher, etc. The apparatus includes two laterally extending support bars, as for example are shown at 13 and 14. Connector means connects to and extends between the bars for positioning them in fixed separated condition, there being work receiving space 15 between the bars. See for example work 11 occupying such space 15 between the bars 13 and 14, and two longitudinally extending, laterally spaced rods 16 and 17 extending between the bars.

Bar leveling means, such as jack screws 18 and 19 extend downwardly from the bars, for supporting them on a support bed, as for example a machine tool bed 20. The leveling means are adjustable to adjust relative leveling of the bars, as for example to precisely orient the work 11 relative to the tool 12, which may travel horizontally and vertically relative to the work, as indicated by arrows 22 and 23, in FIG. 2.

Also provided are work clamping pistons carried by the bars for hydraulically actuated movement toward space 15, for engaging the work, to hold the work in fixed position relative to the bed. See for example three pistons 26 carried by bar 13 and three pistons 27 carried by bar 14. FIG. 6 shows the group of pistons 26 as generally longitudinally spaced or opposed relative to the group of pistons 27.

Figure 9:
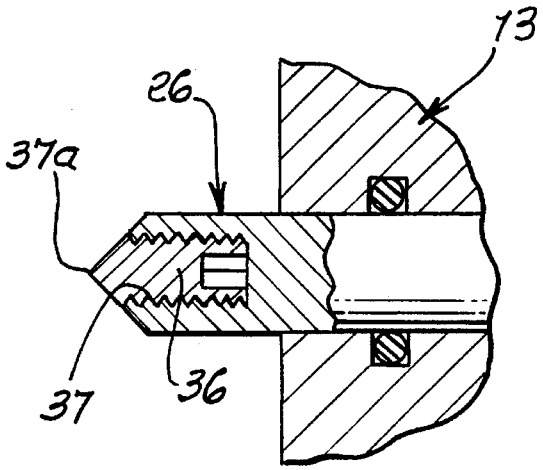
FIG. 9 is an enlarged fragmentary view taken axially through a piston on lines 9—9 of FIG. 8 to show piston structure.

FIG. 1 shows the apparatus 10 in inverted position, to be placed downwardly over and connected to work 11 seating on a surface 29. The apparatus enables pick-up of the work and upright re-orientation to FIG. 2 position, in which the apparatus now supports the work as on a milling or boring tool base, or other base, indicated at 20, for processing as by tool 12. The invention enables pick-up of work having variable offset surfaces 31 and 32 to be engaged by the pistons. See work end shoulder 33 offset from end shoulder 34, and engaged by pistons 27, in FIGS. 1 and 2. Pistons 26 engage work end surface or shoulder 35 which may also be variable (with offset portions). The pistons 26 and 27 have reduced dimension end portions to laterally engage the work surfaces 33–35; thus, the piston ends may taper, toward the work, as shown. See for example FIG. 9 showing inserts 36 threadably received at 37 in piston 26, and having a hardened and tapering tip 37*a*. Three such pistons carried by each bar, as at 26 and 27, enable stable three-point support of the work by each bar, despite variable work surfaces of unpredictable conformation.

DETAILED DESCRIPTION

Figure 3:
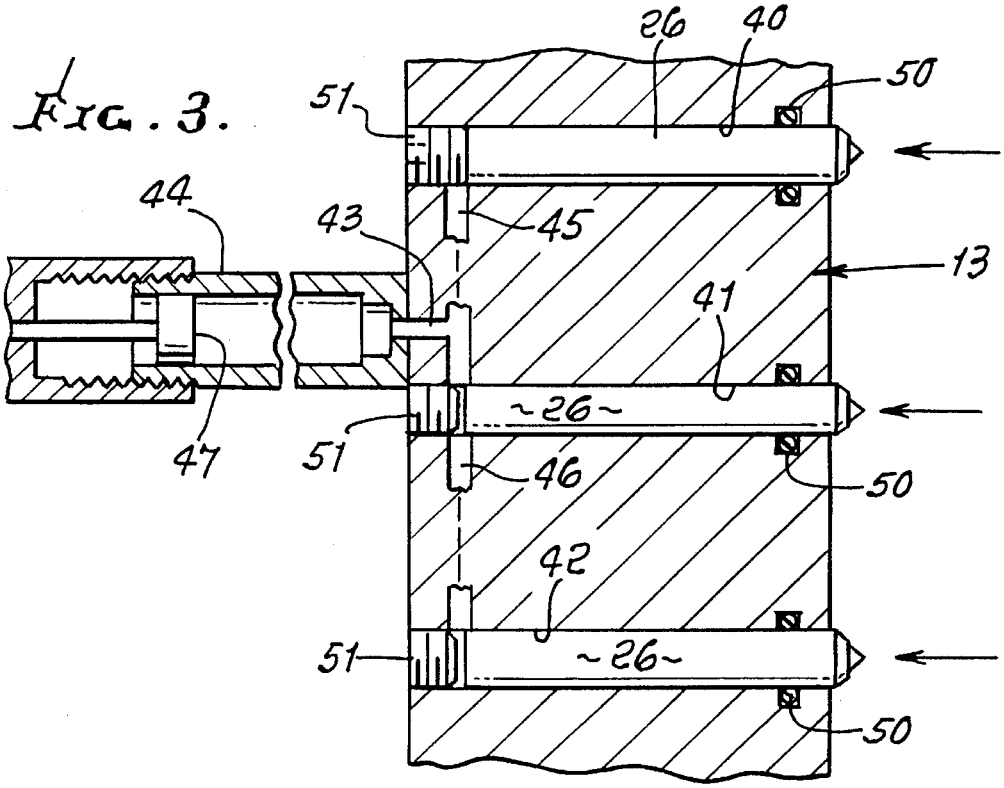
FIG. 3 is an enlarged schematic view showing multiple pistons in a bar and their hydraulic intercommunication.
Figure 8:
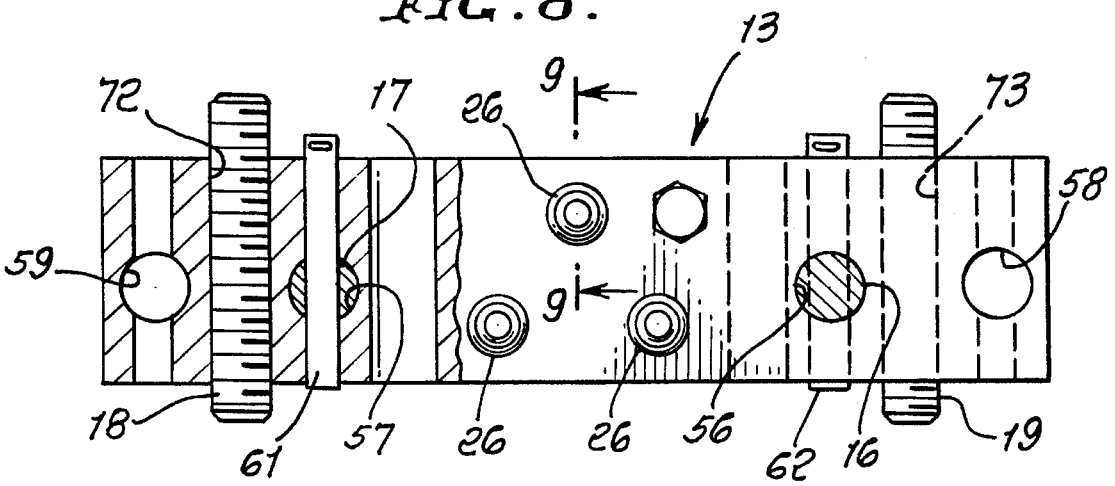
FIG. 8 is an enlarged end view, partially in section, showing bar and construction, and taken on lines 8—8 of FIG. 6.

Referring to FIGS. 3–8, the three pistons 26 carried by bar 13, are movable endwise, in parallel relation, within parallel bores 40–42. One piston is located above the level of the other two, as seen in FIG. 8, to provide balanced three-point support for the work 11. Referring to FIG. 3, hydraulic pressure is supplied to all three pistons, simultaneously, as via passages in the bar, and extending at 43 from pressure supply cylinder 44, and extending at 45 and 46 from 43. Piston 47 in cylinder 44 is movable rightwardly to pressurize hydraulic fluid supplied to 43, 45 and 46. Those passages communicate with the bores 40–42, thereby urging the pistons 26 rightwardly. In a similar manner, the three pistons 27 may be urged leftwardly, in bar 14.

Figure 4:
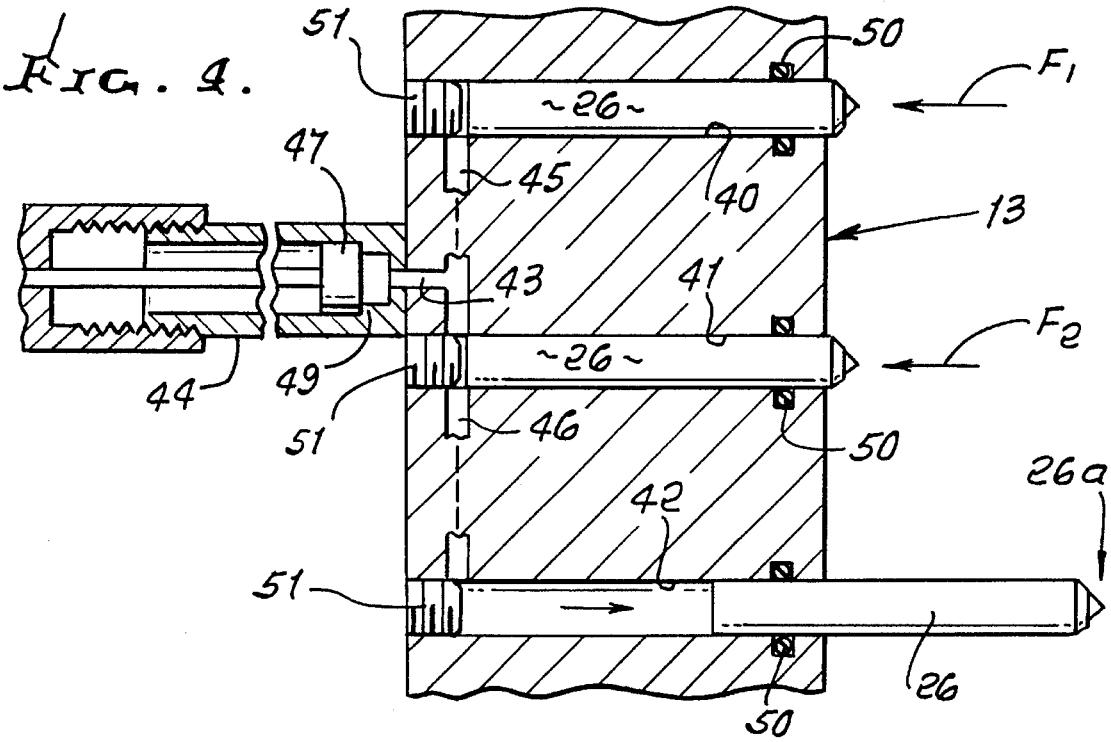
FIG. 4 is a view like FIG. 3, showing one of the pistons extended to maximum extent.

FIG. 4 shows that the pistons 26 cannot be displaced rightwardly completely from bar 13, since if two pistons 26 are held in retracted position as by forces $F_1$ and $F_2$, or gripped work structure, the remaining piston can only be driven rightwardly as to the position indicated at 26*a*, when the pressure piston 46 has stroked rightwardly to the limit indicated by stop shoulder 49 in cylinder 44. O-ring seals about pistons 26 are indicated at 50, and bore plugs are seen at 51. The bores 40–42 are elongated, as shown, and the pistons 26 fit the bores along elongated surfaces defined by the pistons.

Figure 5:
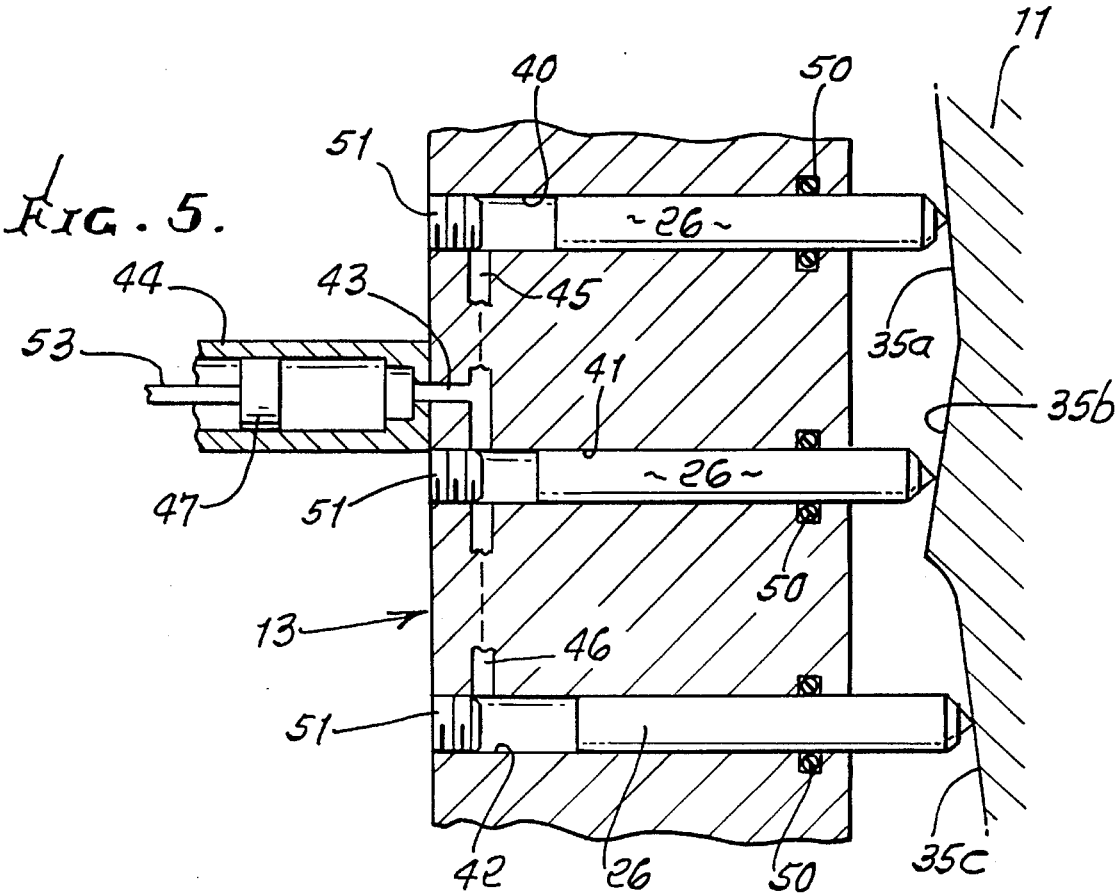
FIG. 5 is a view like FIG. 3, but showing the multiple pistons extended to engage a work surface of varying conformation.

FIG. 5 shows the normal work gripping condition, with all three pistons 26 displaced rightwardly to varying extent, to grip the variable surfaces 35*a*, 35*b* and 35*c* of the work 11. Adjustable displacement means for displacing hydraulic fluid toward all the pistons 26 is represented by control (pusher) rod 53 for piston 46 in the actuator cylinder 45. The protruding pistons 26 can be pushed leftwardly into FIG. 3 original position, after rightward urging of rod 53 is discontinued. This is accomplished after release of the work.

The two laterally spaced connecting rods 16 and 17 are typically received in openings in the bars 13 and 14, as shown in FIG. 6. See for example the openings provided by through bores 56 and 57 in the like bars 13 and 14. Alternate openings 58 and 59 may be provided to selectively receive the rods, to enlarge or otherwise vary the lateral width of the work receiving opening 15. Thus, if rod 17 is shifted to be received by openings 59, the space 15 will be enlarged; and if rod 16 is then shifted to openings 58, the space 15 will be even further enlarged, to receive work of larger size. The rods 16 and 17 contain through openings extending diametrically, as shown, to pass connector pins or elements 61 and 62, as for example is seen in FIG. 8, whereby the rods are fixed to the bores. Such pins are removable to enable rod position shifting as described and also to enable adjustable movement of the bars toward or away from one another. See the pin openings 63 and 64 through the rods, and spaced along the rods, in FIG. 6.

Figure 10:
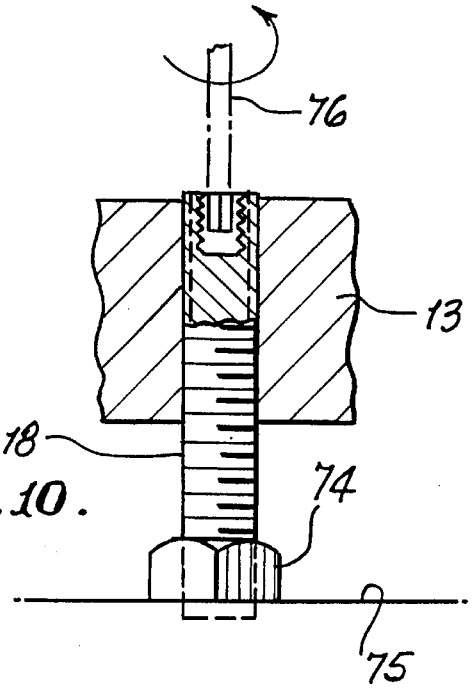
FIG. 10 is a vertical section showing structure of bar leveling means.

Finally, the bar leveling means carried by each bar is shown in FIG. 8 to include two threaded members such as jack screws 18 and 19 projecting downwardly from threaded openings 72 and 73 in each bar. One of the two bars may carry only one jack screw, if desired. Upon selective rotation of the screws, as by tool 76 in FIG. 10, the support positions of their lower ends is adjusted, to adjust bar and rod leveling. Hold down members may be carried by the screws, as represented at 74 in FIG. 10; and elements 74 may connect to a machine tool bed, represented at 75. The jack screws may be used for leveling only; and means may be provided to hold the unit to the machine tool bed or table.

I claim:

1. Apparatus for clamping and orienting work relative to a tool, for processing, comprising, in combination a) two laterally extending longitudinally separated support bars, and connector means connected to and extending between said bars for positioning them in fixed separated condition, there being work receiving space between the bars, b) bar leveling means extending downwardly from said bars for supporting the bars on a support bed, said means being adjustable to adjust the leveling of the bars, c) there being elongated bores in the bars and elongated work clamping pistons carried by the bars for hydraulically actuated movement in said bores toward said work receiving space for engaging and clamping the work to hold the work in fixed position relative to said bed, the pistons fitting the bores along elongated surfaces defined by the pistons, d) multiple of said pistons carried by each bar and hydraulic fluid passages in each said bar to intercommunicate the pistons carried by that bar, the pistons having reduced end portions in the form of inserts having hardened tips to locally engage work surfaces, e) and adjustable displacement means for displacing hydraulic fluid toward all of said pistons carried by each bar, displacing only that amount of hydraulic fluid toward all of said pistons carried by each bar as will preclude complete displacement of any piston from the bar, f) each piston being free of restraint that would block complete piston displacement from the bar, g) whereby work may be received in the space between the bars, with said leveling means extending upwardly, after which the pistons may be caused to clamp the work, and the bars and work then inverted to cause the leveling means to support the work on a support bed.

2. The combination of claim 1 wherein each bar has spaced apart sides, the pistons protruding from one of said sides, and said displacement means protruding from another of said sides.

3. The combination of claim 1 wherein said leveling means includes two threaded members projecting downwardly from threaded openings in one bar, and at least one threaded member projecting downwardly from at least one threaded opening in the other bar.

4. The combination of claim 1 including a hold-down member associated with each bar and located below the bar for attachment to said bed, said hold-down member carried by the leveling means to extend therebelow.

5. The combination of claim 1 wherein said connection means comprises two longitudinally extending laterally spaced rods extending between said bars.

6. The combination of claim 5 including openings in said bars for receiving said rods, there being at least three of said openings in each bar whereby two of said openings receive the rods and the third openings are adapted to alternately receive one of the rods.

7. The combination of claim 1 wherein there are three of said pistons carried by each bar, there being three cylindrical openings in each bar to receive the three pistons.

8. The combination of claim 7 wherein said pistons are independently movable in said openings, in directions extending toward said work space.

9. The combination of claim 6 wherein the rods have adjustable pin connection to at least one of the bars, whereby the bars can be adjustably shifted lengthwise of the rods, and to selected positions at which the rods and bars are interconnected.

* * * * *